US012331623B1

(12) United States Patent
Chen et al.

(10) Patent No.: US 12,331,623 B1
(45) Date of Patent: Jun. 17, 2025

(54) METHODS FOR DIAGNOSING CONTROL EFFECTIVENESS OF FRACTURE HEIGHTS IN HYDRAULIC FRACTURING BY COMBINING MONITORING PRESSURE SIGNALS

(71) Applicant: SOUTHWEST PETROLEUM UNIVERSITY, Sichuan (CN)

(72) Inventors: Xiyu Chen, Chengdu (CN); Manqing Qian, Chengdu (CN); Yongming Li, Chengdu (CN); Jinzhou Zhao, Chengdu (CN); Xia Dan, Chengdu (CN); Linyao Yu, Chengdu (CN); Zhibo Yu, Chengdu (CN)

(73) Assignee: SOUTHWEST PETROLEUM UNIVERSITY, Chengdu (CN)

( * ) Notice: Subject to any disclaimer, the term of this patent is extended or adjusted under 35 U.S.C. 154(b) by 0 days.

(21) Appl. No.: 19/051,212

(22) Filed: Feb. 12, 2025

(30) Foreign Application Priority Data

Aug. 23, 2024 (CN) ..... 202411165040.1

(51) Int. Cl.
*E21B 43/26* (2006.01)
*E21B 49/00* (2006.01)

(52) U.S. Cl.
CPC ..... *E21B 43/26* (2013.01); *E21B 49/00* (2013.01)

(58) Field of Classification Search
CPC ..... E21B 49/00; E21B 43/26
See application file for complete search history.

(56) References Cited

U.S. PATENT DOCUMENTS

| | | | | |
|---|---|---|---|---|
| 5,947,200 | A * | 9/1999 | Montgomery | E21B 43/26 166/305.1 |
| 6,876,959 | B1 | 4/2005 | Peirce et al. | |
| 10,689,972 | B1 | 6/2020 | Zhao et al. | |
| 10,711,604 | B2 * | 7/2020 | Johnson | E21B 43/267 |
| 11,118,450 | B2 * | 9/2021 | Zhao | E21B 43/26 |
| 11,365,618 | B2 * | 6/2022 | Johnson | E21B 47/11 |
| 12,050,297 | B2 * | 7/2024 | AlSinan | E21B 49/02 |
| 2016/0370499 | A1 * | 12/2016 | Berard | G01V 99/00 |
| 2024/0076980 | A1 * | 3/2024 | Yong | G01V 20/00 |

FOREIGN PATENT DOCUMENTS

| | | |
|---|---|---|
| CN | 113536706 A | 10/2021 |
| CN | 116956424 A | 10/2023 |

OTHER PUBLICATIONS

First Office Action in Chinese Application No. 202411165040.1 mailed on Oct. 11, 2024, 9 pages.
Decision to Grant a Patent in Chinese Application No. 202411165040.1 mailed on Oct. 16, 2024, 4 pages.

* cited by examiner

*Primary Examiner* — Kenneth L Thompson
(74) *Attorney, Agent, or Firm* — Porus IP LLC

(57) ABSTRACT

The embodiments of the present disclosure provide a method for diagnosing control effectiveness of a fracture height in hydraulic fracturing by combining monitoring a pressure signal, comprising: obtaining engineering data and geological data; calculating a fracture slit fluid pressure, a double-logarithmic slope of the fracture slit fluid pressure, and a bedding fracture pressure; updating a growth time of the fracture height and a reference pressure based on the fracture height in hydraulic fracturing; based on determining whether a fracturing construction operation ends, updating the cumulative fracturing time or calculating a ratio of the growth time of the fracture height to the total time of hydraulic fracturing.

11 Claims, 3 Drawing Sheets

METHODS FOR DIAGNOSING CONTROL EFFECTIVENESS OF FRACTURE HEIGHTS IN HYDRAULIC FRACTURING BY COMBINING MONITORING PRESSURE SIGNALS

CROSS REFERENCE TO RELATED APPLICATIONS

The present disclosure claims priority to Chinese Patent Application No. 202411165040.1, filed on Aug. 23, 2024, the entire contents of which are incorporated herein by reference.

TECHNICAL FIELD

The present disclosure relates to the field of hydraulic fracturing technology for the development of oil and gas reservoirs, and in particular, to a method for diagnosing control effectiveness of a fracture height in hydraulic fracturing by combining monitoring a pressure signal.

BACKGROUND

Reservoir rocks in oil and gas reservoirs generally have relatively low porosity and permeability, which require large-scale hydraulic fracturing to enhance production and create high-conductivity fractures to improve oil and gas recovery. One of the key challenges in determining the success of hydraulic fracturing operations is the precise control of fracture height. During the fracturing process, the greater the vertical extension of hydraulic fractures in the reservoir, the more fully the oil and gas resources are utilized, resulting in higher post-fracturing production. However, once the hydraulic fractures extend excessively into non-reservoir or water-bearing layers, it can significantly damage the effectiveness of the production enhancement. This can result in wasted fracturing fluid and proppant, and in more severe cases, may lead to serious issues such as wellbore water flooding. On-site engineers often control fracture height by adjusting fracturing designs or using manners such as injecting agents of fracture height control. However, these measures often lack feedback information, making it difficult to be further optimized. Therefore, accurately assessing the control effectiveness of fracture height during the fracturing process is crucial for optimizing fracturing processes and improving production enhancement results.

Existing technologies for diagnosing the fracture height rarely consider the impact of near-horizontal bedding on the extension of the fracture height, making it difficult to accurately assess the control effectiveness of fracture height under different fracturing designs. Therefore, there is an urgent need for a method for diagnosing control effectiveness of a fracture height that considers the influence of the near-horizontal bedding.

SUMMARY

In response to the above problem, the present disclosure provides a method for diagnosing control effectiveness of a fracture height in hydraulic fracturing by combining monitoring a pressure signal.

The technical program of the present disclosure is as follows:

A method for diagnosing control effectiveness of a fracture height in hydraulic fracturing by combining monitoring a pressure signal is provided, comprising following operations:

S1: obtaining engineering data and geological data of a target oil and gas well, denoting a cumulative fracturing time as t, and setting a time step for simulation computation as $\Delta t$, setting a reference pressure $p_r$ in an initial state as 0 Pa, and a growth time $t_p$ of the fracture height in the initial state as 0 s;

S2: calculating a fracture slit fluid pressure $p_{frac}$ at the cumulative fracturing time t and a double-logarithmic slope n of the fracture slit fluid pressure at the cumulative fracturing time, and calculating a bedding fracture pressure $p_e$ based on a bedding dip angle;

S3: determining whether the fracture height in hydraulic fracturing grows at the cumulative fracturing time t based on the fracture slit fluid pressure $p_{frac}$, the double-logarithmic slope n of the fracture slit fluid pressure, and the bedding fracture pressure $p_e$:

in response to $p_{frac}>p_e$ and $|n|<0.1$, determining the fracture height in hydraulic fracturing not growing at the cumulative fracturing time t;

in response to $p_{frac}\leq p_e$ or $|n|\geq 0.1$, determining the fracture height in hydraulic fracturing growing at the cumulative fracturing time t, updating the growth time $t_p$ of the fracture height to $t_p+\Delta t$, and updating the reference pressure $p_r$ to $p_{frac}$;

S4: determining whether a fracturing construction operation ends based on the cumulative fracturing time t and a total time of hydraulic fracturing $T_a$:

in response to $t<T_a$, determining the fracturing construction operation not ending, updating the cumulative fracturing time t to $t+\Delta t$, and repeating step S2 to step S4;

in response to $t\geq T_a$, determining the fracturing construction operation ending and proceeding to S5;

S5: calculating a ratio G of the growth time $t_p$ of the fracture height to the total time of hydraulic fracturing $T_a$, and diagnosing the control effectiveness of the fracture height based on the ratio G. The smaller the ratio G is, the better the control effectiveness of the fracture height is.

BRIEF DESCRIPTION OF THE DRAWINGS

The present disclosure will be further illustrated by way of exemplary embodiments, which will be described in detail by means of the accompanying drawings. These embodiments are not limiting, and in these embodiments, the same numbering denotes the same structure, where.

DETAILED DESCRIPTION

The present disclosure is further described below in connection with embodiments. It should be noted that the embodiments and the technical features in the embodiments in the present disclosure can be combined with each other without conflict. It should be noted that, unless otherwise indicated, all technical and scientific terms used in the present disclosure have the same meanings as are commonly understood by one of ordinary skill in the art to which the present disclosure belongs. The terms "include" or "comprise" and similar expressions used in the present disclosure indicate that the elements or items listed after these terms are covered by the elements or items preceding them, including equivalents, without excluding other elements or items.

Figure 1:
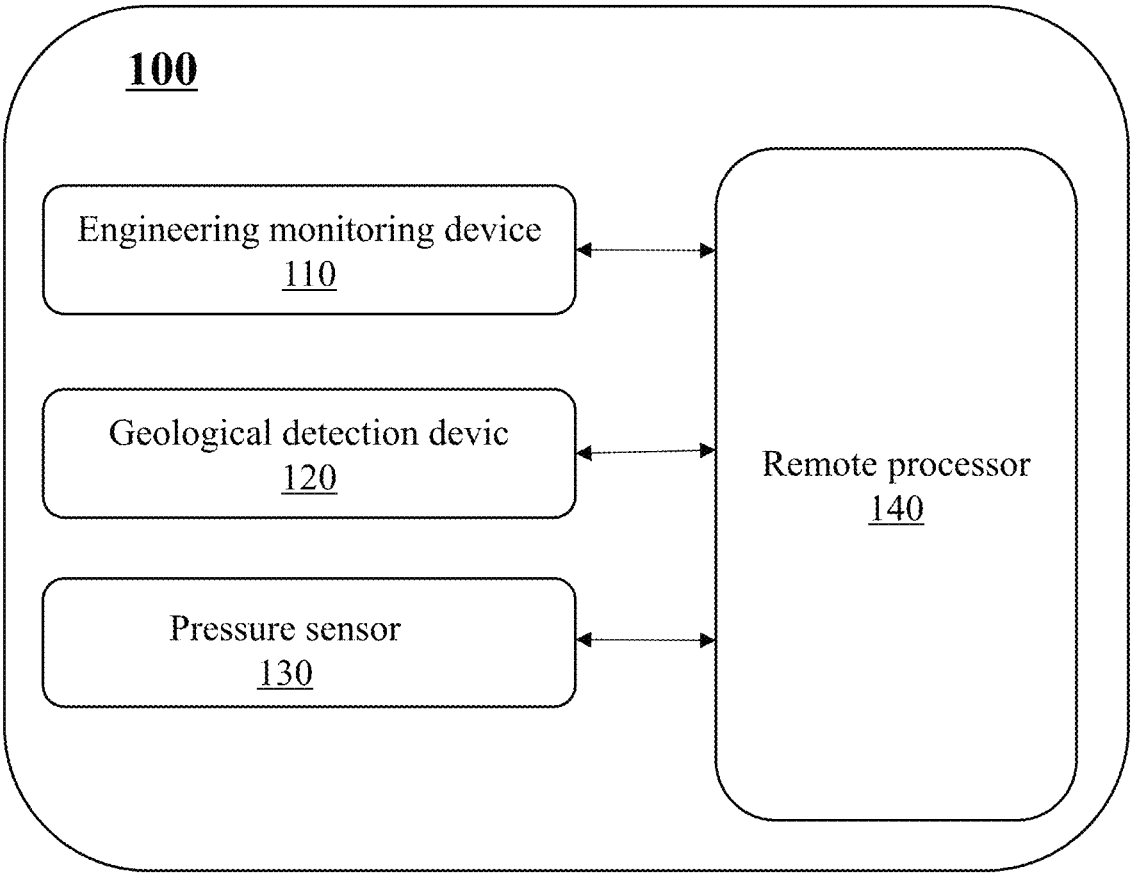
FIG. 1 is a schematic diagram illustrating exemplary modules of a system for diagnosing control effectiveness of a fracture height in hydraulic fracturing by combining monitoring a pressure signal according to some embodiments of the present disclosure.

FIG. 1 is a schematic diagram illustrating exemplary modules of a system for diagnosing control effectiveness of a fracture height in hydraulic fracturing by combining monitoring a pressure signal according to some embodiments of the present disclosure.

In some embodiments, the system for diagnosing control effectiveness of the fracture height in hydraulic fracturing by combining monitoring a pressure signal 100 (hereafter referred to as the system 100) includes an engineering monitoring device 110, a geological detection device 120, a pressure sensor 130, and a remote processor 140. The engineering monitoring device 110 and the geological detection device 120 may be deployed at a site where a target oil and gas well is located.

The engineering monitoring device 110 may be configured to detect and obtain engineering data. The engineering monitoring device 110 may be deployed on a production line of an oil and gas well. For example, the engineering monitoring device 110 includes a video monitoring system and an interactable platform. For example, the video monitoring system includes an image capture device. The interactable platform may enable interaction between a user and the system 100.

The geological detection device 120 may be configured to detect and obtain geological data. For example, the geological detection device 120 includes a geological radar, an electromagnetic instrument, or the like. The geological radar may measure a subsurface structure through electromagnetic wave propagation and may be configured to investigate a subsurface hydrogeological condition and geotechnical characteristics. The electromagnetic instrument may include geoelectric, geomagnetic, ground radar, or the like. The electromagnetic instrument may be configured to explore an underground electromagnetic signal and physical characteristics and identify subsurface strata and mineral resources.

In some embodiments, the pressure sensor 130 is deployed within a wellhead of the target oil and gas well and configured to obtain a pressure at the wellhead. The target oil and gas well may be a well that is used for exploration and development of subterranean oil and gas resources.

In some embodiments, the remote processor 140 is configured to:

obtain engineering data and geological data of the target oil and gas well, and initialize a cumulative fracturing time t, a time step $\Delta t$, a reference pressure $p_r$, and a growth time $t_p$ of a fracture height;

calculate a fracture silt fluid pressure $p_{frac}$ corresponding to the cumulative fracturing time t and a double-logarithmic slope n of the fracture silt fluid pressure at the cumulative fracturing time based on a pressure inside a wellbore of a target fracturing section and engineering data, and calculate a bedding fracture pressure $p_e$ based on a bedding dip angle;

determine whether a fracture height in hydraulic fracturing grows at the cumulative fracturing time t based on the fracture silt fluid pressure $p_{frac}$, the double-logarithmic slope n of the fracture silt fluid pressure, and the bedding fracture pressure $p_e$;

determine whether a fracturing construction operation ends based on the cumulative fracturing time t and a total time of hydraulic fracturing $T_a$. In response to determining the fracturing construction operation not ending, the fracture silt fluid pressure $p_{frac}$, the double-logarithmic slope n of the fracture silt fluid pressure, and the bedding fracturing pressure $p_e$ are re-calculated. Whether the hydraulic height in hydraulic fracturing grows at an updated cumulative fracturing time t is determined based on the updated fracture silt fluid pressure $p_{frac}$, the updated double-logarithmic slope n of the updated fracture silt fluid pressure, and the updated bedding fracturing pressure $p_e$, and whether the fracturing construction operation ends based on the updated cumulative fracturing time t and the total time of hydraulic fracturing $T_a$. In response to determining the fracturing construction operation ending, following steps are proceeded:

calculate a ratio G of the growth time $t_p$ of the fracture height to the total time of hydraulic fracturing $T_a$ to diagnose control effectiveness of the fracture height.

In some embodiments, the remote processor is further configured to determine the pressure of the wellbore at the target fracturing section based on a pressure monitored at the wellhead, a frictional resistance of fracturing fluid flowing along the wellbore, and the engineering data.

In some embodiments, the remote processor is further configured to determine the frictional resistance $p_f$ of the fracturing fluid flowing along the wellbore based on a frictional resistance of clear water flowing along the wellbore and a drag reduction ratio.

In some embodiments, the remote processor is further configured to determine the drag reduction ratio based on the engineering data and a flow rate of the fracturing fluid in the wellbore; and, determine the frictional resistance of the clear water flowing along the wellbore based on the engineering data.

In some embodiments, the remote processor is further configured to determine the frictional resistance of the clear water flowing along the wellbore based on the engineering data and a Fanning friction factor. The Fanning friction factor may be determined based on the engineering data.

In some embodiments, the remote processor is further configured to determine the flow rate of the fracturing fluid flowing along the wellbore based on engineering data.

In some embodiments, the fracture silt fluid pressure $p_{frac}$ is correlated with a displacement of fracturing fluid of a perforation cluster. The remote processor is further configured to determine the displacement of the fracturing fluid of the perforation cluster based on the engineering data.

In some embodiments, a threshold value of the control effectiveness of the fracturing height is set. The threshold value includes a threshold value I and a threshold value II which is greater than the threshold value I. The remote processor is further configured to perform following operations: in response to G≤the threshold value I, determine the control effectiveness of the fracture height is effective; in response to the threshold value I<G≤the threshold value II, determine the control effectiveness of the fracture height is moderate; and in response to G>the threshold value II, determine the control effectiveness of the fracture height is less effective.

Figure 2:
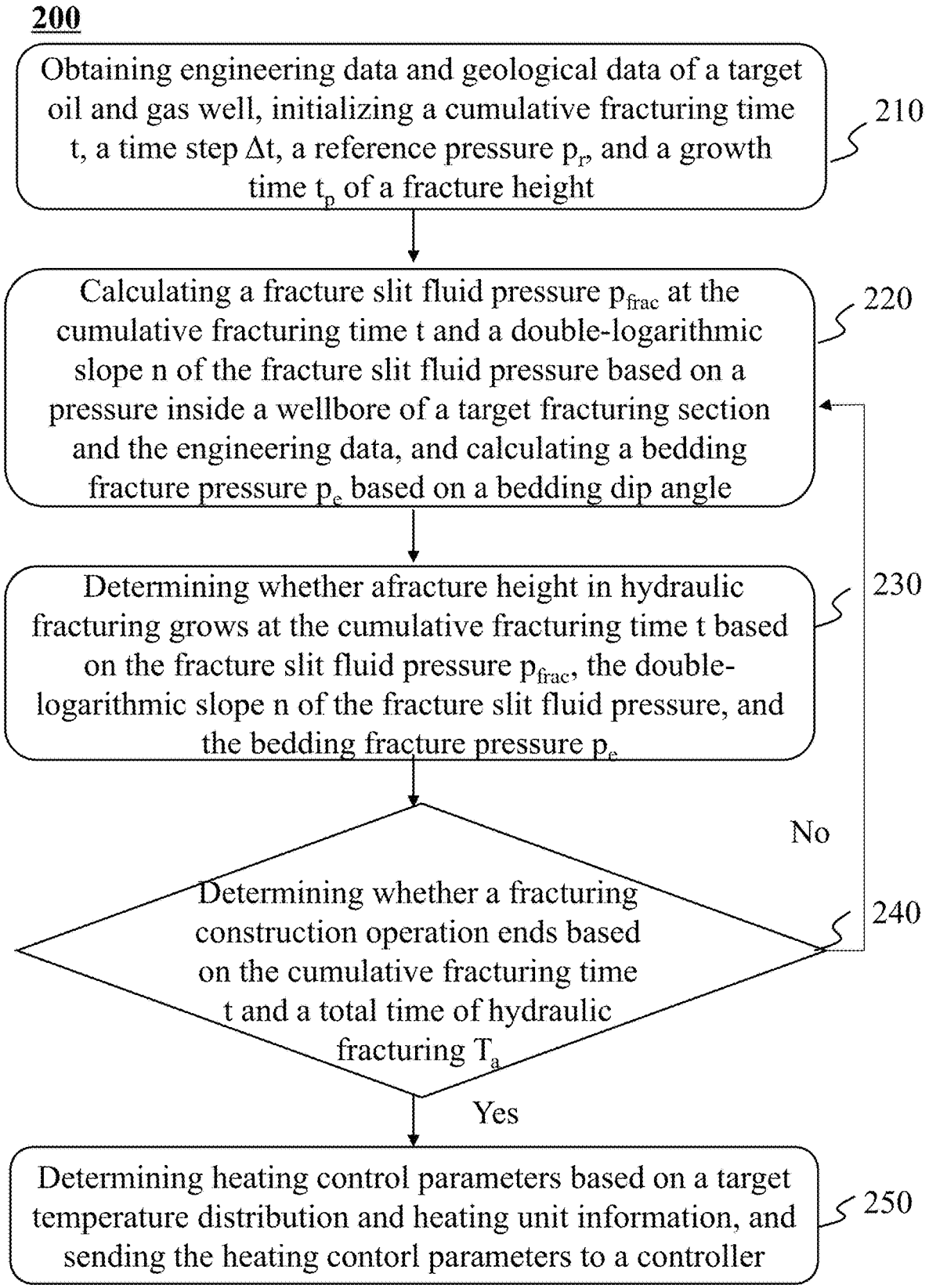
FIG. 2 is a flowchart illustrating a process for diagnosing control effectiveness of a fracture height in hydraulic fracturing by combining monitoring a pressure signal according to some embodiments of the present disclosure.
Figure 3:
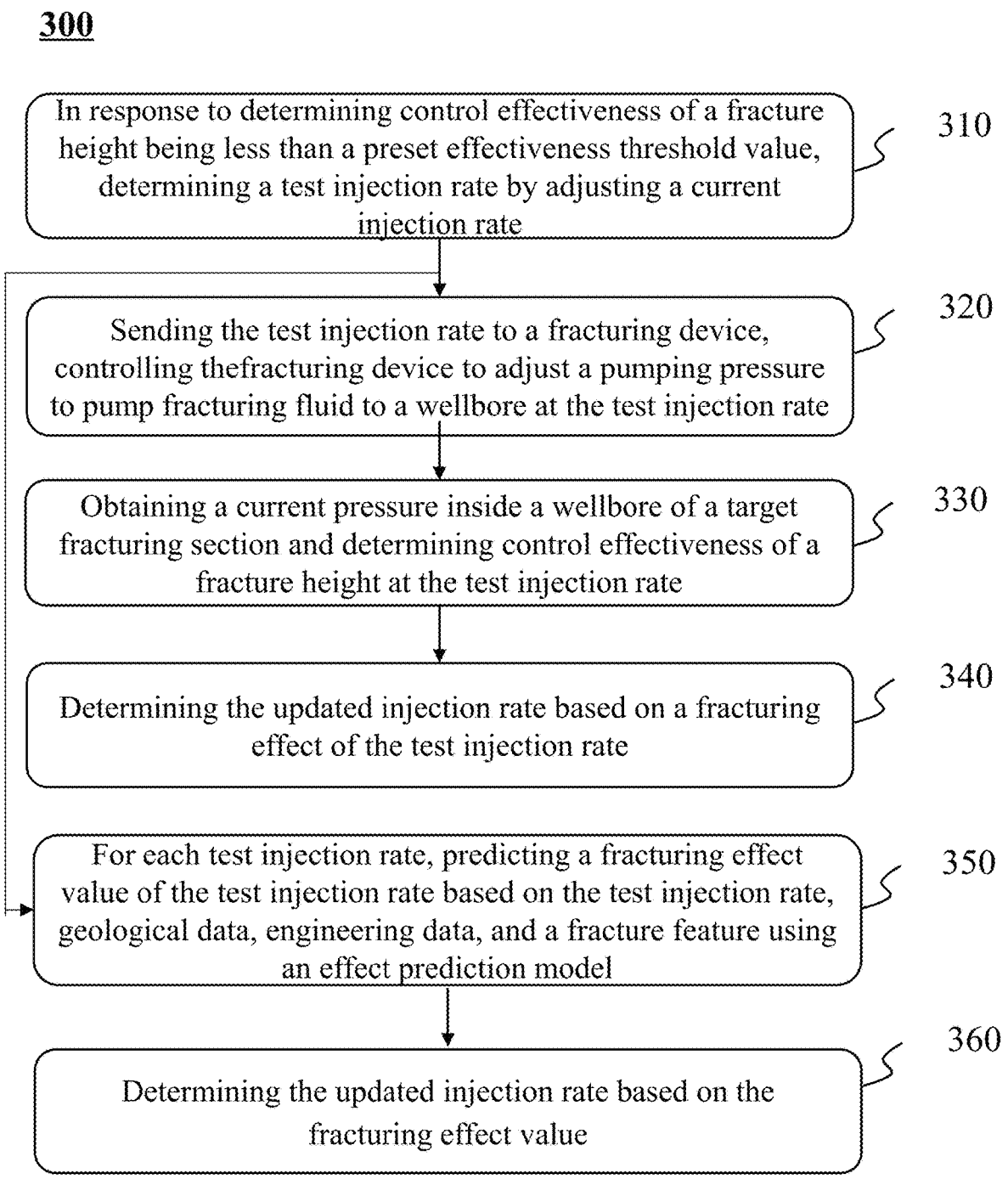
FIG. 3 is a flowchart illustrating a process for determining an updated injection rate according to some embodiments of the present disclosure.

More descriptions about the engineering monitoring device 110, the geological detection device 120, the pressure sensor 130, and the remote processor 140 may be found in FIG. 2 and FIG. 3 and the related descriptions thereof.

FIG. 2 is a flowchart illustrating a process for diagnosing control effectiveness of a fracture height in hydraulic fracturing by combining monitoring a pressure signal according to some embodiments of the present disclosure. In some embodiments, a process 200 is executed by the remote processor 140 of the system 100. As shown in FIG. 2, the process 200 includes operation 210 to operation 250.

In 210, engineering data and geological data of a target oil and gas well are obtained, and a cumulative fracturing time t, a time step Δt, a reference pressure $p_r$, and a growth time $t_p$ of a fracture height are initialized.

In some embodiments, the engineering data includes a length of a wellbore $L_w$ between a wellhead of an oil and gas well and a target fracturing section, a hydrostatic pressure $p_g$ between the oil and gas wellhead and the target fracturing section, an inner diameter D of a wellbore, a number N of a perforation cluster, a perforation number m of the perforation cluster, and a perforation diameter $d_p$ of the perforation cluster in the target fracturing section, a total displacement Q of fracturing fluid, a viscosity of the fracturing fluid, a density p of the fracturing fluid, a concentration $G_c$ of a thickening agent, a concentration $G_p$ of a proppant, and a total time of hydraulic fracturing $T_a$. The geological data includes a minimum horizontal principal stress $\sigma_{min}$, a vertical stress $\sigma_h$, a bedding dip angle α, and a bedding tensile strength Rt.

The hydrostatic pressure refers to a pressure generated by a weight of a liquid oil and gas itself. The inner diameter D of the wellbore refers to a diameter of an actual space available inside the wellbore. The target fracturing section refers to a stratigraphic unit selected for fracturing. The stratigraphic unit refers to a separate unit of subsurface rock that is fractured in a horizontal well. The minimum horizontal principal stress refers to a value of a minimum principal stress along a horizontal direction within a rock or strata. The value of the minimum principal stress refers to a minimum value of a tensile stress or compressive stress that is applied at a midpoint of a stressed structural body. The vertical stress refers to a stress acting along a vertical direction of an object. The bedding dip angle refers to an angle between a level of a rock formation and a horizontal plane. The tensile strength refers to the ability of the rock formation to resist fracture when subjected to a tensile force.

The number of the perforation cluster refers to a count of groupings of perforation clusters. The perforation cluster refers to a group of interconnected perforation guns.

The perforation number of the perforation cluster refers to a count of perforation guns included in a group of perforation clusters. The perforation diameter of the perforation cluster refers to a diameter of the perforation gun in the perforation cluster. The total displacement of the fracturing fluid refers to a volume of the fracturing fluid injected into the oil and gas well per unit of time during a fracturing operation. The viscosity of the fracturing fluid refers to an amount of internal frictional resistance of the fracturing fluid as it flows. The concentration of the thickening agent refers to a percentage of the thickening agent in the liquid gas and oil. The concentration of the proppant refers to a proportion of the proppant in the liquid oil and gas.

The total time of hydraulic fracturing refers to a total time it takes to extract oil using hydraulic fracturing. More descriptions about how to determine the total time of hydraulic fracturing can be referred to Operation 240 and the related descriptions thereof.

The time step refers to a difference between two consecutive time points. The reference pressure refers to a datum value that is used to calculate a pressure difference in the oil and gas well. The growth time of the fracture height refers to a time taken for the fracture height in hydraulic fracturing to grow to a specific height. The specific height may be preset empirically for those skilled in the art.

The fracture height in hydraulic fracturing in hydraulic fracturing refers to a maximum extension distance of a hydraulic fracture along a direction perpendicular to the wellbore. The fracture height in hydraulic fracturing is similar to a fracture height mentioned later.

In some embodiments, the remote processor obtains the engineering data and the geological data of the target oil and gas well through an engineering monitoring device and a geological detection device, and initializes the cumulative fracturing time t, the time step Δt, the reference pressure $p_r$, and the growth time $t_p$ of the fracture height to 0.

In 220, a fracture silt fluid pressure $p_{frac}$ at the cumulative fracturing time t and a double-logarithmic slope n of the fracture silt fluid pressure at the cumulative fracturing time are determined based on a pressure inside a wellbore of the target fracturing section, and a bedding fracture pressure $p_e$ is determined based on the bedding dip angle;

The fracture silt fluid pressure refers to a fluid pressure required for a fracture to extend during hydraulic fracturing.

In some embodiments, the remote processor calculates the fracture silt fluid pressure $p_{frac}$ at the cumulative fracturing time t through a following equation (1):

$$p_{frac} = p_s - \frac{8\rho q^2}{\pi^2 m^2 d_p^4} \tag{1}$$

where $p_{frac}$ denotes the fracture silt fluid pressure at the cumulative fracturing time t in Pa; $p_s$ denotes the pressure inside the wellbore of the target fracturing section in Pa; ρ denotes a density of the fracturing fluid in kg/m$^3$; q denotes a displacement of fracturing fluid of a perforation cluster in m$^3$/s; m denotes a perforation number of the perforation cluster, which is dimensionless; and $d_p$ denotes a perforation diameter of the perforation cluster in m;

The pressure inside the wellbore refers to a pressure exerted on an inner wall of the wellbore during drilling.

The displacement of the fracturing fluid of the perforation cluster refers to a volume of the fracturing fluid injected into the oil and gas well by the perforation cluster per unit of time during a fracturing operation.

In some embodiments, the remote processor also determines the displacement of the fracturing fluid of the perforation cluster based on the engineering data.

In some embodiments, the remote processor determines the displacement q of the fracturing fluid of the perforation cluster through a following Equation (11):

$$q = \frac{Q}{N} \tag{11}$$

where, Q denotes a total displacement of the fracturing fluid in m$^3$/s; N denotes a number of the perforation cluster in the target fracturing section, which is dimensionless.

In some embodiments, the remote processor also determines the pressure inside the wellbore of the target fracturing section based on a pressure monitored at a wellhead, a frictional resistance of the fracturing fluid flowing along the wellbore, and the engineering data.

In some embodiments, the remote processor determines the pressure $p_s$ inside the wellbore of the target fracturing section by a following equation (4):

$$p_s=p_o-p_f+p_g \tag{4}$$

where $p_o$ denotes the pressure monitored at the wellhead in Pa; $p_f$ denotes the frictional resistance of the fracturing fluid flowing along the wellbore in Pa; and $p_g$ denotes a hydrostatic pressure $p_g$ inside the wellbore between the oil and gas wellhead and the target fracturing section in Pa.

In some embodiments, the remote processor obtains the pressure at the wellhead using a pressure sensor deployed at a wellhead of a target oil and gas well.

In some embodiments, the system 100 further includes an early warning device. In response to determining the pressure inside the wellbore of the target fracturing section not satisfying a preset pressure range, the remote processor may be configured to regulate a pumping pressure of a fracturing device to a default pumping pressure, determine a warning intensity, and trigger a warning device to warn at the warning intensity.

The early warning device may be a variety of devices that carry out early warning such as a horn.

The preset pressure range may be a preset range of pressure values at the wellhead. In some embodiments, the remote processor may analyze historical data to identify a range of pressure values at a wellhead in a similar wellbore section where no fracturing failure occurred and designate the range of pressure values as the preset pressure range. The fracturing failure may include a triggered alarm during fracturing, a formation rupture, a poor fracturing result, or the like. The poor fracturing result refers to a ratio of a specific difference to an expected fracture height in hydraulic fracturing that is less than a preset deviation threshold value. The specific difference refers to a difference between the fracture height in hydraulic fracturing and the expected fracture height in hydraulic fracturing. The expected fracture height in hydraulic fracturing and the preset deviation threshold value may be preset empirically for a person skilled in the art.

In some embodiments, the remote processor increases a warning intensity in response to the pressure inside the wellbore of the target fracturing section exceeding an upper limit of the preset pressure range by a greater degree, or the pressure inside the wellbore of the target fracturing section falling below a lower limit of the preset pressure range by a greater extent.

In some embodiments of the present disclosure, when the pressure inside the wellbore of the target fracturing section does not satisfy the preset pressure range, the early warning device is triggered to warn an operator to adjust the pumping pressure of the fracturing device to a default pumping pressure, an early warning intensity is determined, and the early warning device is triggered to warn the operator at the warning intensity, so as to remind the operator to take corresponding measures in time to avoid safety accidents.

The frictional resistance of the fracturing fluid flowing along the wellbore refers to a frictional force that the fracturing fluid is subjected to as it flows along the wellbore during fracturing.

In some embodiments, the remote processor may further determine the frictional resistance $p_f$ of the fracturing fluid flowing along the wellbore based on a frictional resistance of clear water flowing along a wellbore and a drag reduction ratio.

In some embodiments, the remote processor may calculate the frictional resistance $p_f$ of the fracturing fluid flowing along the wellbore by a following equation (5):

$$p_f=\sigma p_c \tag{5}$$

where $\sigma$ denotes the drag reduction ratio, which is dimensionless; and $p_c$ denotes the frictional resistance of the clear water flowing along the wellbore in Pa.

The frictional resistance of the clear water flowing along the wellbore refers to a resistance generated by the viscosity and inertia of a fluid and a friction of walls of the wellbore when the clear water flows along the wellbore.

In some embodiments, the remote processor may also determine the frictional resistance of the clear water flowing along the wellbore based on the engineering data and a Fanning friction factor.

In some embodiments, the remote processor calculates the frictional resistance $p_c$ of the clear water flowing along the wellbore by a following equation (7):

$$p_c = 2f\frac{\rho u^2 L_w}{2D} \tag{7}$$

where f denotes the Fanning friction factor, which is dimensionless; u denotes a flow rate of the fracturing fluid in the wellbore in m/s; $L_w$ denotes the length of the wellbore between the oil and gas wellhead and the target fracturing section in m; and D denotes an inner diameter of the wellbore in m.

The Fanning coefficient factor refers to a localized parameter used in calculations of continuum mechanics.

In some embodiments, the remote processor calculates the Fanning friction factor fby following equation (8) and equation (9):

$$f = 0.046\mathrm{Re}^{-0.2} \tag{8}$$

$$\mathrm{Re} = \frac{\rho u D}{\mu} \tag{9}$$

where $R_e$ denotes Reynolds number of flow of the fracturing fluid, which is dimensionless; and denotes a viscosity of the fracturing fluid in Pa·s.

The Reynolds number of flow of the fracturing fluid may be a dimensionless number that characterizes a flowing situation of a fluid.

The flow rate of the fracturing fluid in the wellbore refers to a volume of the fracturing fluid that flows through the wellbore per minute during fracturing.

In some embodiments, the remote processor may determine the flow rate of the fracturing fluid in the wellbore based on the engineering data.

In some embodiments, the remote processor calculates the flow rate u of the fracturing fluid the wellbore by a following equation (10):

$$u = 1.2732\frac{Q}{D^2} \tag{10}$$

where Q denotes the total displacement of the fracturing fluid in $m^3/s$.

The drag reduction ratio refers to a proportion by which a frictional resistance of a fluid inside the wellbore is reduced after using a friction reducer.

In some embodiments, the remote processor calculates the drag reduction ratio σ by a following equation (6):

$$\ln\left(\frac{1}{\sigma}\right) = 2.20323 - \frac{2.4457}{u} - 0.6016\frac{G_c}{u} - 0.1639\ln G_c - 2.3367 * 10^{-4} G_p e^{\frac{0.11983}{G_c}} \quad (6)$$

where u denotes the flow rate of the fracturing fluid in the wellbore in m/s; $G_c$ denotes the concentration of the thickening agent in kg/m$^3$; and $G_p$ denotes the concentration of the proppant in kg/m$^3$.

The double-logarithmic slope of the fracture silt fluid pressure may be used to characterize a change in a difference between the fracture silt fluid pressure and a reference pressure in a unit time step.

In some embodiments, the remote processor calculates the double-logarithmic slope n of the fracture silt fluid pressure at the cumulative fracturing time t by a following equation (2):

$$n = \frac{\log_{10}\left(\frac{p_{frac} - pr}{1000000}\right)}{\log_{10}(\Delta t)} \quad (2)$$

where n denotes the double-logarithmic slope of the fracture silt fluid pressure, which is dimensionless, $p_r$ denotes the reference pressure in Pa, and Δt denotes the time step in s.

In some embodiments, the remote processor may further determine a first target feature vector based on the pressure inside the wellbore of the target fracturing section and the engineering data; determine a first associated feature vector based on the first target feature vector through a first vector database; determine a reference fracture silt fluid pressure and a double-logarithmic slope of the reference fracture silt fluid pressure corresponding to the first associated feature vector as the fracture silt fluid pressure $p_{frac}$ and the double-logarithmic slope n of the fracture silt fluid pressure.

The first vector database includes a plurality of first reference feature vectors. Each of the plurality of first reference feature vectors corresponds to a reference fracture silt fluid pressure and a double-logarithmic slope of the reference fracture silt fluid pressure. The plurality of first reference feature vectors may be constructed based on historical data.

In some embodiments, the remote processor may determine a first reference feature vector in the first vector database that satisfies a target preset condition based on a first target feature vector, and determine the first reference feature vector that satisfies the target preset condition as the first associated feature vector. In some embodiments, the target preset condition may be a minimal vector distance from the first target feature vector, etc.

The bedding fracture pressure refers to a fluid pressure at a bottom of the well when a formation is subjected to hydraulic fracturing.

In some embodiments, the remote processor may determine the bedding fracture pressure based on a bedding dip angle through a first preset control table. The preset control table includes a correspondence between a reference bedding dip angle and a reference bedding fracture pressure. The first preset control table may be constructed based on a priori knowledge or the historical data.

In some embodiments, the remote processor may calculate the bedding fracture pressure $p_e$ by a following equation (3):

$$p_e = \frac{\sigma_{min} + \sigma_h}{2} + \frac{\sigma_{min} - \sigma_h}{2}\cos(\pi - 2\alpha) + R_t \quad (3)$$

where $p_e$ denotes the bedding fracture pressure in Pa; $\sigma_{min}$ denotes a minimum horizontal principal stress in Pa; $\sigma_h$ denotes a vertical stress in Pa; α denotes the bedding dip angle, rad; and $R_t$ denotes a bedding tensile strength in Pa.

In 230, whether the fracture height in hydraulic fracturing grows at the cumulative fracturing time t is determined based on the fracture silt fluid pressure $p_{frac}$, the double-logarithmic slope n of the fracture silt fluid pressure, and the bedding fracture pressure $p_e$.

In some embodiments, in response to determining $p_{frac} > p_e$ and $|n| < 0.1$, the remote processor determines the fracture height in hydraulic fracturing not growing at the cumulative fracturing time t. In response to determining $p_{frac} \leq p_e$ or $|n| \geq 0.1$, the remote processor determines the fracture height in hydraulic fracturing growing at the cumulative fracturing time t, updates the growth time $t_p$ of the fracture height to $t_p + \Delta t$, and updates the reference pressure $p_r$ to $p_{frac}$.

In some embodiments, in response to determining the fracture height in hydraulic fracturing not growing at the cumulative fracturing time t, the remote processor determines an acquisition frequency of the pressure sensor based on a current fracture height in hydraulic fracturing and controls the pressure sensor to re-acquire the pressure at the wellhead based on the acquisition frequency.

The acquisition frequency refers to a count of times per unit of time that the pressure sensor acquires the pressure at the wellhead.

In some embodiments, the higher the fracture height in hydraulic fracturing, the higher the acquisition frequency of the pressure sensor.

In some embodiments of the present disclosure, as the fracture height in hydraulic fracturing increases, factors controlling further growth of the fracture height become more difficult to manage. To ensure the healthy development of the hydraulic fracture, it is required to control the process more precisely. Therefore, the acquisition frequency of the pressure sensors needs to be set higher.

In 240, whether a fracturing construction operation ends is determined based on the cumulative fracturing time t and the total time of hydraulic fracturing $T_a$.

In some embodiments, in response to $t < T_a$, the remote processor determines the fracturing construction operation not ending, updates the cumulative fracturing time t to $t + \Delta t$, and repeats operation 220 to operation 240. In response to $t \geq T_a$, the remote processor determines the fracturing construction operation ending and proceeds to operation 250.

In some embodiments, the geological data further includes a near-horizontal bedding feature. The remote processor may further determine a total time of hydraulic fracturing $T_a$ required to reach a target fracture height based on the near-horizontal bedding feature, the engineering data, and the target fracture height. The time step Δt may be determined based on the total time of hydraulic fracturing $T_a$ and the near-horizontal bedding feature.

The near-horizontal bedding feature refers to a feature associated with a near-horizontal bedding. The near-horizontal bedding feature may include features such as tectonics, sediments, and other features of the near-horizontal bedding.

In some embodiments, the remote processor may obtain the near-horizontal bedding feature of the near-horizontal bedding by analyzing a picture captured by an image acquisition device using an image analysis manner. The image analysis manner may include a texture feature extraction manner, etc.

The target fracture height refers to a final fracture height in hydraulic fracturing that needs to be achieved.

In some embodiments, the remote processor may determine the target fracture height based on the near-horizontal bedding feature.

In some embodiments, the remote processor may determine the target fracture height based on the near-horizontal bedding feature through a second preset control table. The second preset control table includes a correspondence between a reference near-horizontal bedding feature and a reference target fracture height. The second preset control table may be constructed based on a priori knowledge or the historical data. The remote processor may construct the second preset table by taking historical data that has good control effectiveness of a fracture height in the historical data as sample data.

For example, the remote processor may calculate a difference between each fracture height in hydraulic fracturing in the historical data and the expected fracture height, and obtain a ratio of the difference to the expected fracture height in hydraulic fracturing. In response to determining the ratio being less than the preset deviation threshold value, the remote processor determines the fracture height in hydraulic fracturing as a fracture height in hydraulic fracturing with good control effectiveness, and constructs the second preset control table based on a historical near-horizontal bedding feature and a historical target fracture height corresponding to the fracture height in hydraulic fracturing.

In some embodiments of the present disclosure, determining the target fracture height based on the near-horizontal bedding feature can be more closely tailored to an actual situation.

In some embodiments, the remote processor may determine a second target feature vector based on the near-horizontal bedding feature, the engineering data, and the target fracture height; determine a second associated feature vector through the second vector database based on the second target feature vector, and determine a reference total time of hydraulic fracturing required for a reference target fracture height corresponding to the second associated feature vector as a total time of hydraulic fracturing required for the target fracture height.

The second vector database includes a plurality of second reference feature vectors. Each of the plurality of second reference feature vectors corresponds to a reference total time of hydraulic fracturing required for a reference target fracture height. In some embodiments, the remote processor may construct cluster vectors based on the reference near-horizontal bedding feature, reference engineering data, the reference target fracture height, and the reference total time of hydraulic fracturing in the sample data, and performs clustering on the cluster vectors to form a preset count of clustering centers; construct the second reference feature vector based on a reference near-horizontal bedding feature, reference engineering data, and a reference target fracture height corresponding to each clustering center, and designate the reference total time of hydraulic fracturing as a label of the second reference feature vector.

In some embodiments, the remote processor may determine a second reference feature vector that satisfies the target preset condition in the second vector database based on the second target feature vector, and determine the second reference feature vector that satisfies the target preset condition as the second associated feature vector. In some embodiments, the target preset condition may be a minimal vector distance from the second target feature vector.

In some embodiments, the remote processor may also determine the total time of hydraulic fracturing required to reach the target fracture height based on the near-horizontal bedding feature, the engineering data, and the target fracture height using a time determination model.

In some embodiments, the time determination model is a machine learning model. In some embodiments, the time determination model is a Neural Network (NN) model or a Deep Neural Network (DNN) model.

In some embodiments, the time determination model may be obtained by training based on a large number of first training samples with a first label.

In some embodiments, the first training sample may include a historical sample near-horizontal bedding feature, historical sample engineering data, and a historical sample target fracture height, and the first label may include a total time of hydraulic fracturing required to reach the historical sample target fracture height.

In some embodiments, the first training sample and the first label may be obtained based on the historical data.

In some embodiments, the first training sample includes different training sets and test sets. The training sets and test sets may be determined based on engineering data and geological data from different oil and gas wells in the first training sample, and a learning rate of each first training sample is correlated to subsequent control effectiveness of a fracture height corresponding to the first training sample.

In some embodiments, the remote processor may divide the engineering data and the geological data of different oil and gas wells into grades, respectively; combine graded engineering data and graded geological data two by two to form a plurality of combination grades; divide the first training sample into a plurality of databases in accordance with the combination grade. Each database corresponds to one combination grade. For each of the plurality of databases, the first training sample is randomly selected, and an extracted first training sample is assigned to the test set and the training set in accordance with a preset ratio until first training samples of all databases have been assigned, then a final test set and final training set are obtained.

In some embodiments, the remote processor may divide the engineering data and the geological data in multiple ways. For example, the remote processor may divide the engineering data according to a viscosity of the fracturing fluid, and divide the geological data according to a thickness of a hydrocarbon formation.

The preset ratio may be 3:7.

The learning rate refers to a crucial hyperparameter in a machine learning model. The learning rate may determine a magnitude or step size of parameter updates $p_f$ the time determination model during training.

In some embodiments, a learning rate of a first training sample A is correlated to a current iteration round k of the time determination model and control effectiveness A of a fracture height corresponding to the first training sample. For example, the smaller the current iteration round k is, the better the control effectiveness A of a fracture height corresponding to the first training sample is, and the larger the learning rate factor of the first training sample A is.

In some embodiments of the present disclosure, correlating the learning rate of the first training sample to the current iteration round of the time determination model and the first training sample corresponding to the current iteration round can improve the accuracy of a prediction result of the time determination model obtained by training.

In some embodiments, a plurality of first training samples with the first label are input into an initial time determination model, and then a loss function is constructed based an output of the initial time determination model and the first label, and parameters of the initial time determination model are iteratively updated based on the loss function by gradient descent or other manners until conditions such as the loss function being less than a threshold, the loss function converging, or a training period reaching a threshold are satisfied, then a trained time determination model is obtained.

In some embodiments, the remote processor may determine the time step Δt based on the total time of hydraulic fracturing $T_a$ and the near-horizontal bedding feature.

In some embodiments, in response to determining the total time of hydraulic fracturing being greater than or equal to a total time threshold value, the remote processor sets the time step Δt longer. In response to determining the total time of hydraulic fracturing being less than the total time threshold value and the more complex the configuration is in the near-horizontal bedding feature, the remote processor sets the time step Δt longer.

In some embodiments of the present disclosure, by considering an actual near-horizontal bedding feature, the engineering data, and the target fracture height, the total time of hydraulic fracturing and the time step determined are more reasonable, which in turn optimizes the growth height of the hydraulic fracture.

In 250, the control effectiveness of the fracture height is diagnosed based on the ratio G of the growth time $t_p$ of the fracture height to the total time of hydraulic fracturing $T_a$.

The control effectiveness of the fracture height can reflect effectiveness of controlling a height extension of the hydraulic fracture along a vertical direction during fracturing. The control effectiveness of the fracture height may be expressed in terms of grades.

In some embodiments, the smaller the ratio G, the remote processor judges the better the control effectiveness of the fracture height to be.

In some embodiments, the remote processor sets the threshold value of the control effectiveness of the fracture height. The threshold value includes a threshold value I and a threshold value II which is greater than the threshold value I. In response to determining G≤the threshold value I, the remote processor determines the control effectiveness of the fracture height is effective; in response to determining the threshold value I<G≤the threshold value II, the remote processor determines the control effectiveness of the fracture height is moderate; and in response to determining G>the threshold value II, the remote processor determines the control effectiveness of the fracture height is less effective.

In some embodiments, the remote processor may also determine an updated injection rate in response to determining the control effectiveness of the fracture height being less than a preset effectiveness threshold value; and control the fracturing device to regulate the pumping pressure to enable the fracturing fluid to be pumped to the wellbore at the updated injection rate.

The fracturing device refers to a specialized mechanical device used to perform a fracturing operation.

In some embodiments, the preset effectiveness threshold value may be preset by a person skilled in the art based on experience.

The updated injection rate refers to an injection rate an after adjustment is made to a current injection rate. The injection rate refers to a rate at which a petroleum fluid is injected into the wellbore by the fracturing device.

In some embodiments, in response to determining the fracture height in hydraulic fracturing over a plurality of consecutive historical time steps Δt not growing, the remote processor determines a fracture feature based on the engineering data, the geological data, and the cumulative fracturing time t, and determines the updated fracture injection rate based on the geological data, the engineering data, and the fracture feature.

The fracture feature may include the fracture height, a spread area of the fracture, or the like.

In some embodiments, the remote processor may determine the fracture feature based on the engineering data, the geological data, and the cumulative fracturing time t though a third vector database. A process by which the remote processor determines the fracture feature through the third vector database is similar to a process by which the remote processor determines the total time of hydraulic fracturing required for the target fracture height through the second vector database. More descriptions about this can be referred to the descriptions of the second vector database.

In some embodiments, the remote processor may determine the updated injection rate based on the geological data, the engineering data, and the fracture feature through a fourth vector database. A process by which the remote processor determines the updated injection rate through the fourth vector database is similar to the process by which the remote processor determines the total time of hydraulic fracturing required for the target fracture height through the second vector database. More descriptions about this can be referred to the descriptions of the second vector database.

In some embodiments, the remote processor may also determine a sequence of height growth rates corresponding to the current injection rate based on a change situation of fracture silt fluid pressures $p_{frac}$ and bedding fracture pressures $p_e$ over the plurality of consecutive historical time steps Δt; and determine the updated injection rate based on the geological data, the engineering data, the fracture feature, and the sequence of height growth rates corresponding to the current injection rate.

The sequence of height growth rates refers to a sequence consisting of height growth rates corresponding to the plurality of historical time steps Δt.

In some embodiments, for a height growth rate corresponding to each historical time step Δt, the remote processor may determine the height growth rate by a following equation:

$v=k.(P_{frac}-P_e)$; where v denotes the height growth rate and k denotes an empirical constant. k may be preset by a person skilled in the art based on experience. More descriptions about $P_{frac}$ and $P_e$ can be referred to the operation 220.

In some embodiments, the remote processor may combine the height growth rate corresponding to each historical time step Δt obtained by computation to obtain the sequence of height growth rates.

In some embodiments, the remote processor may determine the updated injection rate based on the geological data, the engineering data, the fracture feature, and the sequence of height growth rates corresponding to the current injection rate through a fifth vector database. A process by which the remote processor determines the updated injection rate through the fifth vector database is similar to the process by which the remote processor determines the total time of hydraulic fracturing required for the target fracture height through the second vector database. More descriptions about this can be referred to the descriptions of the second vector database.

In some examples, in response to determining the control effectiveness of the fracture height being less than the preset effectiveness threshold value, the remote processor may determine a test injection rate by adjusting the current injection rate; send the test injection rate to the fracturing device to control the fracturing device to adjust the pumping pressure, which enables the fracturing fluid to be pumped into the wellbore at the test injection rate; obtain a current pressure inside the wellbore of the target fracturing section and determine control effectiveness of the fracture height at the test injection rate; and determine the updated injection rate based on the control effectiveness of the fracture height at the test injection rate. More detailed description about this can be referred to FIG. 3 and the related descriptions thereof.

In some embodiments of the present disclosure, a historical growth process of the current fracture height in hydraulic fracturing based on the height growth rates corresponding to the plurality of historical time steps $\Delta t$ is conducive to determining a more effective updated injection rate.

The present disclosure comprehensively considers various factors, such as a frictional resistance of the wellbore, pressure drop across perforations and within a fracture, a bedding strength, and bedding failure modes, and their impact on the extension of the fracture height during hydraulic fracturing, which allows a diagnostic result of the control effectiveness of the fracture height to better align with an actual operating condition.

The present disclosure combines monitoring a pressure signal, calculates the double-logarithmic slope of the fracture silt fluid pressure and a bedding failure condition, and conducts a comprehensive analysis to diagnose whether the fracture height is suppressed, ensuring objectivity.

The method disclosed in the present disclosure is simple and computationally efficient, enabling effective diagnosis of the growth of the fracture height under specific fracturing designs and geological conditions, which provides valuable support for the subsequent optimization of a control process of the fracture height.

FIG. 3 is a flowchart illustrating a process for determining an updated injection rate according to some embodiments of the present disclosure. In some embodiments, a process 300 is executed by the remote processor 140 of the system 100. As shown in FIG. 3, the process 300 includes operation 310 to operation 360.

In 310, in response to determining control effectiveness of a fracture height being less than a preset effectiveness threshold value, a test injection rate is determined by adjusting a current injection rate.

The test injection rate refers to an injection rate used for a test.

In some embodiments, the remote processor may randomly increase or decrease a random value for the current injection rate to obtain the test injection rate. An increasing or decreasing random value may be preset empirically by those skilled in the art.

In some embodiments, the remote processor, after determining the test injection rate, performs Operation 320 to Operation 340, or Operation 350 to Operation 360 as follows.

In 320, the test injection rate is sent to a fracturing device, the fracturing device is controlled to adjust a pumping pressure to pump fracturing fluid to a wellbore at the test injection rate.

In 330, a current pressure inside a wellbore of a target fracturing section is obtained and control effectiveness of the fracture height at the test injection rate is redetermined.

More descriptions about the pressure inside the wellbore, and determining the control effectiveness of the fracture height at the test injection rate can be referred to Operation 220 to Operation 250 in FIG. 2 and the related descriptions thereof.

In 340, the updated injection rate is determined based on a fracturing effect of the test injection rate.

In some embodiments, in response to determining the fracturing effect of the test injection rate being improved compared to a fracturing effect of the current injection rate, the remote processor designates the test injection rate as the updated injection rate. In response to determining the fracturing effect of the test injection rate being not improved compared to the fracturing effect of the current injection rate, it indicates that a fracturing effect between two consecutive time points is not improved, i.e., an optimal injection rate has already been found. Therefore, there is no need to update an injection rate.

In some embodiments, after the hydraulic fracturing, the remote processor obtains a detected displacement of the fracturing fluid of each perforation cluster, calculates the inverse of a standard deviation or the inverse of an average value of the displacement of the fracturing fluid based on the displacement of the fracturing fluid, and characterizes the fracturing effect in terms of the inverse of the standard deviation or the inverse of the average value. Fracturing fluid moisture resistance tester may detect the displacement of the fracturing fluid of the individual perforation cluster. The remote processor may obtain the displacement of the fracturing fluid of the individual perforation cluster using the fracturing fluid moisture resistance tester.

In 350, for each test injection rate, a fracturing effect value of the test injection rate is predicted based on the test injection rate, geological data, engineering data, and a fracture feature using an effect prediction model.

The fracturing effect value refers to a numerical value used to represent fracturing effectiveness of the test injection rate.

In some embodiments, the effect prediction model is a machine learning model. In some embodiments, the effect prediction model is a Neural Network (NN) model or a Deep Neural Network (DNN) model.

In some embodiments, the effect prediction model is trained based on a large number of second training samples with a second label.

In some embodiments, the second training sample includes a historical sample injection rate, historical sample geological data, historical sample engineering data, and a historical sample fracture feature, and the second label includes an actual fracturing effect value of the historical sample injection rate. In some embodiments, the second training sample is obtained based on historical data, and the second label is obtained based on manual labeling.

In some embodiments, a training process of the effect prediction model is similar to a training process of a time determination model. More descriptions about the effect prediction model can be referred to the training process of the time determination model and the related descriptions thereof.

In 360, the updated injection rate is determined based on the fracturing effect value.

In some embodiments, the remote processor may designate a test injection rate with a largest fracturing effect value as the updated injection rate.

In some embodiments of the present disclosure, the effect prediction model processes and analyzes the test injection rate, the geological data, the engineering data, and the fracture feature in real-time to make quick decisions, henceforth reducing the cost of multiple adjustments and improving productivity.

The present disclosure provides a method for diagnosing control effectiveness of a fracture height in hydraulic fracturing by combining monitoring a pressure signal, comprising following operations:

S1: obtaining engineering data and geological data of a target oil and gas well, denoting a cumulative fracturing time as t, and setting a time step for simulation computation as $\Delta t$, setting a reference pressure $p_r$ in an initial state as 0 Pa, and a growth time $t_p$ of a fracture height in the initial state as 0 s.

S2: calculating a fracture slit fluid pressure $p_{frac}$ at the cumulative fracturing time t and a double-logarithmic slope n of the fracture slit fluid pressure at the cumulative fracturing time, and calculating a bedding fracture pressure $p_e$ based on a bedding dip angle.

In a specific embodiment, the fracture silt fluid pressure $p_{frac}$ at the cumulative fracturing time t is calculated by a following equation:

$$p_{frac} = p_s - \frac{8\rho q^2}{\pi^2 m^2 d_p^4} \tag{1}$$

where $p_{frac}$ denotes the fracture slit fluid pressure at the cumulative fracturing time t in Pa; $p_s$ denotes a pressure inside a wellbore of a target fracturing section in Pa; $\rho$ denotes a density of fracturing fluid in kg/m$^3$; q denotes a displacement of fracturing fluid of a perforation cluster in m$^3$/s; m denotes a perforation number of the perforation cluster, which is dimensionless; and $d_p$ denotes a perforation diameter of the perforation cluster in m;

The double-logarithmic slope n of the fracture slit fluid pressure at the cumulative fracturing time t is calculated by a following equation:

$$n = \frac{\log_{10}\left(\frac{p_{frac} - p_r}{1000000}\right)}{\log_{10}(\Delta t)} \tag{2}$$

where n denotes the double-logarithmic slope of the fracture slit fluid pressure, which is dimensionless; $p_r$ denotes the reference pressure in Pa; and $\Delta t$ denotes the time step s;

A bedding dip angle $\alpha$ of a near-horizontal bedding satisfies $0 \le \alpha \le \pi/4$. A bedding fracture may be mainly controlled by a stress field and a tensile strength of a bedding, and the bedding fracture pressure $p_e$ based on the bedding dip angle is calculated by a following equation:

$$p_e = \frac{\sigma_{min} + \sigma_h}{2} + \frac{\sigma_{min} - \sigma_h}{2}\cos(\pi - 2\alpha) + R_t \tag{3}$$

where $p_e$ denotes the bedding fracture pressure in Pa; $\sigma_{min}$ denotes a minimum horizontal principal stress in Pa; $\sigma_h$ denotes a vertical stress in Pa; $\alpha$ denotes the bedding dip angle in rad; and $R_t$ denotes a bedding tensile strength in Pa;

In a specific embodiment, a pressure $p_s$ inside a wellbore of a target fracturing section is calculated by a following equation:

$$p_s = p_o - p_f + p_g \tag{4}$$

where $p_o$ denotes a pressure monitored at a wellhead in Pa; $p_f$ denotes a frictional resistance of fracturing fluid flowing along the wellbore in Pa; and $p_g$ denotes a hydrostatic pressure $p_g$ inside the wellbore between an oil and gas wellhead and the target fracturing section in Pa.

In the above embodiment, the pressure $p_o$ monitored at the wellhead may be obtained by monitoring through a pressure sensor arranged at the oil and gas wellhead.

In a specific embodiment, the frictional resistance $p_f$ of the fracturing fluid flowing along the wellbore is calculated by a following equation:

$$p_f = \sigma p_c \tag{5}$$

where $\sigma$ denotes a drag reduction ratio, which is dimensionless; and $p_c$ denotes a frictional resistance of clear water flowing along the wellbore in Pa.

In a specific embodiment, the drag reduction ratio $\sigma$ is calculated by a following equation:

$$\ln\left(\frac{1}{\sigma}\right) = 2.20323 - \frac{2.4457}{u} - 0.6016\frac{G_c}{u} - 0.1639\ln G_c - 2.3367 * 10^{-4} G_p e^{\frac{0.11983}{G_c}} \tag{6}$$

where u denotes a flow rate of the fracturing fluid in the wellbore in m/s; $G_c$ denotes a concentration of a thickening agent in kg/m$^3$, and $G_p$ denotes a concentration of a proppant in kg/m$^3$.

The frictional resistance $p_c$ of the clear water flowing along the wellbore is calculated by a following equation:

$$p_c = 2f^{\frac{\rho u^2 L_w}{2D}} \tag{7}$$

where f denotes a Fanning friction factor, which is dimensionless; u denotes the flow rate of the fracturing fluid in the wellbore in m/s; $L_w$ denotes a length of the wellbore between the oil and gas wellhead and the target fracturing section in m; and D denotes an inner diameter of the wellbore in m.

In a specific embodiment, the Fanning friction factor f is calculated by a following equation:

$$f = 0.046\mathrm{Re}^{-0.2} \tag{8}$$

$$\mathrm{Re} = \frac{\rho u D}{\mu} \tag{9}$$

where $R_e$ denotes Reynolds number of flow of the fracturing fluid, which is dimensionless; and denotes a viscosity of the fracturing fluid in Pa·s.

In a specific embodiment, the flow rate u of the fracturing fluid in the wellbore is calculated by a following equation:

$$u = 1.2732\frac{Q}{D^2} \tag{10}$$

where Q denotes a total displacement of the fracturing fluid in $m^3/s$.

In a specific embodiment, a displacement q of the fracturing fluid of the perforation cluster is calculated by a following equation:

$$q = \frac{Q}{N} \tag{11}$$

where Q denotes the total displacement of the fracturing fluid in $m^3/s$; and N denotes a number of the perforation cluster in the target fracturing section, which is dimensionless.

It should be noted that calculation manners shown in equation (4) to equation (11) are only preferred manners for calculating corresponding parameters in the present disclosure, and other manners in the prior art that can obtain the parameters may also be applicable to the present disclosure.

S3: determining whether the fracture height in hydraulic fracturing grows at the cumulative fracturing time t based on the fracture slit fluid pressure $p_{frac}$, the double-logarithmic slope n of the fracture slit fluid pressure, and the bedding fracture pressure $p_e$:

in response to $p_{frac}>p_e$ and $|n|<0.1$, it is indicated that the extension of the fracture height in hydraulic fracturing is inhibited by a near-horizontal bedding, determining the fracture height in hydraulic fracturing not growing at the cumulative fracturing time t; and in response to $p_{frac}\leq p_e$ or $|n|\geq 0.1$, it is indicated that the extension of the fracture height in hydraulic fracturing is not inhibited by the near-horizontal bedding, determining the fracture height in hydraulic fracturing growing at the cumulative fracturing time t, updating the growth time $t_p$ of the fracture height to $t_p+\Delta t$, and updating the reference pressure $p_r$ to $p_{frac}$;

S4: determining whether a fracturing construction operation ends based on the cumulative fracturing time t and a total time of hydraulic fracturing $T_a$:

in response to $t<T_a$, determining the fracturing construction operation not ending, updating the cumulative fracturing time t to $t+\Delta t$, and repeating step S2 to step S4; and in response to $t\geq T_a$, determining the fracturing construction operation ending and proceeding to S5;

S5: calculating a ratio G of the growth time $t_p$ of the fracture height to the total time of hydraulic fracturing $T_a$, and diagnosing the control effectiveness of the fracture height based on the ratio G. The smaller the ratio G is, the better the control effectiveness of the fracture height is.

In this operation, an equation for calculating the ratio G is as follows:

$$G=t_p/T_a \tag{12}$$

where $t_p$ denotes the growth time of the fracture height in s and $T_a$ denotes the total time of hydraulic fracturing in s.

In a specific embodiment, when diagnosing the control effectiveness of the fracture height based on the ratio G, a threshold value of the control effectiveness of the fracture height is set, including a threshold value I and a threshold value II which is greater than the threshold value I, and specific diagnostics criteria are as follows:

in response to determining that G is less than or equal to the threshold value I, determining the control effectiveness of the fracture height is effective;

in response to determining that G is greater than the threshold value I and less than or equal to the threshold value II, determining the control effectiveness of the fracture height is moderate; and in response to determining that G is greater than the threshold value II, determining the control effectiveness of the fracture height is less effective.

In a specific embodiment, the threshold value I is 0.3 and the threshold value II is 0.7. It should be noted that the threshold value I and the threshold value II are empirical values set by those skilled in the art, and a person skilled in the art may set a threshold value that is more in line with a corresponding target block according to a difference of a target block.

In a specific embodiment, taking an unconventional low-permeability gas well H2 in southern Sichuan as an example, the method for diagnosing control effectiveness of a fracture height in hydraulic fracturing by combining monitoring a pressure signal disclosed in the present disclosure is used to evaluate control effectiveness of a fracture height in hydraulic fracturing of the well, specifically comprising following operations:

(1) obtaining engineering data and geological data of a target oil and gas well, setting a cumulative fracturing time t to 5 s, setting a time step $\Delta t$ as 5 s, and setting a reference pressure $p_r$ in an initial state as 0 and a growth time $t_p$ of a fracture height in the initial state as 0.

In this embodiment, the engineering data and the geological data of the target oil and gas well are shown in Table 1:

TABLE 1

Engineering data and geological data of a first fracturing section in an unconventional low-permeability gas well H2

| Parameters | Data | Unit | Parameters | Data | Unit |
|---|---|---|---|---|---|
| Length of a wellbore $L_w$ between a wellhead of an oil and gas well and a target fracturing section | 3820 | m | Density of fracturing fluid ρ | 1000 | $kg/m^3$ |
| Hydrostatic pressure $p_g$ between a wellhead of an oil and gas well and a target fracturing section | $3.08\times10^7$ | Pa | Concentration of a thickening agent $G_c$ | 1.5 | $kg/m^3$ |
| Inner diameter D of a wellbore | 0.114 | m | Concentration of a proppant $G_p$ | 3.55 | $kg/m^3$ |

TABLE 1-continued

Engineering data and geological data of a first fracturing section in an unconventional low-permeability gas well H2

| Parameters | Data | Unit | Parameters | Data | Unit |
|---|---|---|---|---|---|
| Number N of a perforation cluster of a target fracturing section | 16 | Dimensionless | Total time of hydraulic fracturing $T_a$ | 7300 | S |
| Perforation diameter $d_p$ of a perforation cluster | 0.02 | m | Bedding dip angle α | 30 | rad |
| Perforation number m of a perforation cluster | 8 | Dimensionless | Bedding tensile strength $R_t$ | $3 \times 10^6$ | Pa |
| Total displacement of fracturing fluid Q | 0.267 | $m^3/s$ | Minimum horizontal principal stress $\sigma_{min}$ | $20 \times 10^6$ | Pa |
| Viscosity μ of fracturing fluid | $5 \times 10^{-3}$ | Pa · s | Vertical stress $\sigma_h$ | $35 \times 10^6$ | Pa |

(2) calculating a fracture slit fluid pressure $p_{frac}$ at the cumulative fracturing time t and a double-logarithmic slope n of the fracture slit fluid pressure at the cumulative fracturing time, and a bedding fracture pressure $p_e$ based on a bedding dip angle according to equation (1) to equation (11).

In this embodiment, the number N of the perforation cluster of the target fracturing section is 7, and the bedding fracture pressure $p_e$ obtained through calculation is $3.43\times10^7$ Pa.

(3) determining whether the fracture height in hydraulic fracturing grows at the cumulative fracturing time t based on the fracture slit fluid pressure $p_{frac}$, the double-logarithmic slope n of the fracture slit fluid pressure, and the bedding fracture pressure $p_e$:

in response to $p_{frac}>3.43\times10^7$ Pa and $|n|<0.1$, determining the fracture height in hydraulic fracturing not growing at the cumulative fracturing time t;

in response to $p_{frac}\leq3.43\times10^7$ Pa or $|n|\geq0.1$, determining the fracture height in hydraulic fracturing growing at the cumulative fracturing time t, updating the growth time $t_p$ of the fracture height to $t_p+\Delta t$, and updating the reference pressure $p_r$ to $p_{frac}$.

In this embodiment, when the cumulative fracturing time t is 4715 s, $p_{frac}$ is $8.21\times10^7$ Pa, and n is 0.014, a condition for inhibiting the extension of the fracture height in hydraulic fracturing by a horizontal bedding is satisfied.

(4) determining whether a fracturing construction operation ends based on the cumulative fracturing time t and a total time of hydraulic fracturing $T_a$:

in response to $t<T_a$, determining the fracturing construction operation not ending, updating the cumulative fracturing time t to $t+\Delta t$, and repeating (2) to (4); and in response to $t\geq T_a$, determining the fracturing construction operation ending and proceeding to (5).

In this embodiment, the total time of hydraulic fracturing $T_a$ is 7300 s, and the growth time $t_p$ of the fracture height when the fracturing construction operation ends is 4715 s.

(5) calculating a ratio G of the growth time $t_p$ of the fracture height to the total time of hydraulic fracturing $T_a$, and diagnosing the control effectiveness of the fracture height based on the ratio G.

In this embodiment, the ratio G of the growth time $t_p$ of the fracture height to the total time of hydraulic fracturing $T_a$ is 0.65, and a threshold value I is set to be 0.3 and a threshold value II is set to be 0.7. The ratio G is between the threshold value I and the threshold value II, so control effectiveness of a fracture height of the unconventional low-permeability gas well H2 is moderate.

For further details regarding the method, please refer to the explanations in FIG. 1 to FIG. 3 and the related descriptions.

In summary, the present disclosure is capable of more accurately diagnosing control effectiveness of a fracture height in hydraulic fracturing. Compared to the prior art, the present disclosure offers significant advancements.

The above-mentioned is only a better example of the present disclosure, and is not a limitation of the present disclosure in any form. Although the present disclosure has been disclosed in a better example, it is not intended to limit the present disclosure, and any skilled person familiar with the present disclosure may, within the scope of the technical solutions of the present disclosure, make some changes or modifications as equivalent changes based on the technical contents of the present disclosure, without departing from the technical solutions of the present disclosure. However, any simple modification, equivalent changes, and modifications to the above embodiments based on the technical substance of the present disclosure, without departing from the technical program of the present disclosure, still fall within the scope of the technical program of the present disclosure.

What is claimed is:

1. A method for diagnosing control effectiveness of a fracture height in hydraulic fracturing by combining monitoring a pressure signal, comprising:

S1: obtaining engineering data and geological data of a target oil and gas well, denoting a cumulative fracturing time as t, and setting a time step for simulation computation as Δt, setting a reference pressure $p_r$ in an initial state as 0 Pa, and a growth time $t_p$ of the fracture height in the initial state as 0 s;

S2: calculating a fracture slit fluid pressure $p_{frac}$ at the cumulative fracturing time t and a double-logarithmic slope n of the fracture slit fluid pressure at the cumulative fracturing time, and calculating a bedding fracture pressure $p_e$ based on a bedding dip angle;

wherein the fracture slit fluid pressure $p_{frac}$ at the cumulative fracturing time t is calculated by a following equation:

$$p_{frac} = p_s - \frac{8\rho q^2}{\pi^2 m^2 d_p^4} \tag{1}$$

where $p_{frac}$ denotes the fracture slit fluid pressure at the cumulative fracturing time t in Pa; $p_s$ denotes a pressure inside a wellbore of a target fracturing section in Pa; ρ denotes a density of fracturing fluid in kg/m$^3$; q denotes a displacement of fracturing fluid of a perforation cluster in m$^3$/s; m denotes a perforation number of the perforation cluster, which is dimensionless; and $d_p$ denotes a perforation diameter of the perforation cluster in m;

the double-logarithmic slope n of the fracture slit fluid pressure at the cumulative fracturing time is calculated by a following equation:

$$n = \frac{\log_{10}\left(\frac{p_{frac} - p_r}{1000000}\right)}{\log_{10}(\Delta t)} \tag{2}$$

where n denotes the double-logarithmic slope of the fracture slit fluid pressure, which is dimensionless; $p_r$ denotes the reference pressure in Pa; and Δt denotes the time step s;

the bedding fracture pressure $p_e$ is calculated by a following equation:

$$p_e = \frac{\sigma_{min} + \sigma_h}{2} + \frac{\sigma_{min} - \sigma_h}{2}\cos(\pi - 2\alpha) + R_t \tag{3}$$

where $p_e$ denotes the bedding fracture pressure in Pa; $\sigma_{min}$ denotes a minimum horizontal principal stress in Pa; $\sigma_h$ denotes a vertical stress in Pa; α denotes the bedding dip angle in rad; and $R_t$ denotes a bedding tensile strength in Pa;

S3: determining whether the fracture height in hydraulic fracturing grows at the cumulative fracturing time t based on the fracture slit fluid pressure $p_{frac}$, the double-logarithmic slope n of the fracture slit fluid pressure, and the bedding fracture pressure $p_e$:

in response to $p_{frac}$>pe and |n|<0.1, determining the fracture height in hydraulic fracturing not growing at the cumulative fracturing time t; and in response to $p_{frac}$≤pe or |n|≥0.1, determining the fracture height in hydraulic fracturing growing at the cumulative fracturing time t, updating the growth time $t_p$ of the fracture height to $t_p$+Δt, and updating the reference pressure $p_r$ to $p_{frac}$;

S4: determining whether a fracturing construction operation ends based on the cumulative fracturing time t and a total time of hydraulic fracturing $T_a$:

in response to t<$T_a$, determining the fracturing construction operation not ending, updating the cumulative fracturing time t to t+Δt, and repeating step S2 to step S4; and in response to t≥$T_a$, determining the fracturing construction operation ending and proceeding to S5; and S5: calculating a ratio G of the growth time $t_p$ of the fracture height to the total time of hydraulic fracturing $T_a$, and diagnosing the control effectiveness of the fracture height based on the ratio G, wherein the smaller the ratio G is, the better the control effectiveness of the fracture height is.

2. The method of claim 1, wherein the step S3 further includes:

in response to determining the fracture height hydraulic fracturing not growing at the cumulative fracturing time t, determining an acquisition frequency of a pressure sensor based on a current fracture height in hydraulic fracturing and controlling the pressure sensor to reacquire a pressure at a wellhead based on the acquisition frequency.

3. The method of claim 1, wherein the step S5 further includes:

in response to determining the control effectiveness of the fracture height being less than a preset effectiveness threshold value, determining an updated injection rate; and pumping the fracturing fluid to the wellbore at the updated injection rate by controlling a fracturing device to regulate a pumping pressure.

4. The method of claim 1, wherein in the step S1, the engineering data includes a length of the wellbore $L_w$ between an oil and gas wellhead and the target fracturing section, a hydrostatic pressure $p_g$ between the oil and gas wellhead and the target fracturing section, an inner diameter D of the wellbore, a number N of a perforation cluster of the target fracturing section, a perforation number m of the perforation cluster, and a perforation diameter $d_p$ of the perforation cluster, a total displacement Q of the fracturing fluid, a viscosity of μ the fracturing fluid, a density ρ of the fracturing fluid, a concentration $G_c$ of a thickening agent, a concentration $G_p$ of a proppant, and the total time of hydraulic fracturing $T_a$; and the geological data includes the minimum horizontal principal stress $\sigma_{min}$, the vertical stress $\sigma_h$, the bedding dip angle α, and the bedding tensile strength $R_t$.

5. The method of claim 1, wherein the pressure inside the wellbore of the target fracturing section $p_s$ is calculated by a following equation:

$$p_s = p_o - p_f + p_g \tag{4}$$

where $p_o$ denotes a pressure monitored at a wellhead in Pa; $p_f$ denotes a frictional resistance of the fracturing fluid flowing along the wellbore in Pa; and $p_g$ denotes the hydrostatic pressure $p_g$ between an oil and gas wellhead and the target fracturing section in Pa.

6. The method of claim 5, wherein the frictional resistance $p_f$ of the fracturing fluid flowing along the wellbore is calculated by a following equation:

$$p_f = \sigma p_c \tag{5}$$

where σ denotes a drag reduction ratio, which is dimensionless; and $p_c$ denotes a frictional resistance of clear water flowing along the wellbore in Pa.

7. The method of claim 6, wherein the drag reduction ratio σ is calculated by a following equation:

$$\ln\left(\frac{1}{\sigma}\right) = 2.20323 - \frac{2.4457}{u} - 0.6016\frac{G_c}{u} - 0.1639\ln G_c - 2.3367 * 10^{-4} G_p e^{\frac{0.11983}{G_c}} \tag{6}$$

where u denotes a flow rate of the fracturing fluid in the wellbore in m/s; $G_c$ denotes a concentration of a thickening agent in kg/m$^3$; and $G_p$ denotes a concentration of a proppant in kg/m$^3$; and the frictional resistance $p_c$ of the clear water flowing along the wellbore is calculated by a following equation:

$$p_c = 2f\frac{\rho u^2 L_w}{2D} \tag{7}$$

where f denotes a Fanning friction factor, which is dimensionless; u denotes the flow rate of the fracturing fluid in the wellbore in m/s; $L_w$ denotes a length of the wellbore between the oil and gas wellhead and the target fracturing section in m; and D denotes an inner diameter of the wellbore in m.

8. The method of claim 7, wherein the Fanning friction factor f is calculated by a following equation:

$$f = 0.046\mathrm{Re}^{-0.2} \tag{8}$$

$$\mathrm{Re} = \frac{\rho u D}{\mu} \tag{9}$$

where Re denotes Reynolds number of flow of the fracturing fluid, which is dimensionless; and μ denotes a viscosity of the fracturing fluid in Pa·s.

9. The method of claim 7, wherein the flow rate u of the fracturing fluid in the wellbore is calculated by a following equation:

$$u = 1.2732\frac{Q}{D^2} \tag{10}$$

where Q denotes the total displacement of the fracturing fluid in $m^3/s$.

10. The method of claim 1, wherein the displacement q of the fracturing fluid of the perforation cluster is calculated by a following equation:

$$q = \frac{Q}{N} \tag{11}$$

where Q denotes the total displacement of the fracturing fluid in $m^3/s$; and N denotes a number of the perforation cluster of the target fracturing section, which is dimensionless.

11. The method of claim 1, wherein in the step S5, when diagnosing the control effectiveness of the fracture height based on the ratio G, setting a threshold value of the control effectiveness of the fracture height, including a threshold value I and a threshold value II which is greater than the threshold value I, and specific diagnostics criteria are as follows:

in response to determining that G is less than or equal to the threshold value I, determining the control effectiveness of the fracture height is effective;

in response to determining that G is greater than the threshold value I and less than or equal to the threshold value II, determining the control effectiveness of the fracture height is moderate; and in response to determining that G is greater than the threshold value II, determining the control effectiveness of the fracture height is less effective.

* * * * *